United States Patent [19]

Lo

[11] Patent Number: 4,807,778

[45] Date of Patent: Feb. 28, 1989

[54] RECTANGULAR CONTAINER ASSEMBLY

[76] Inventor: Mai J. Lo, No. 48, Lane 57, Chung Cheng Road, Chungli City, Tao-Yuean Hsien, Taiwan, Taiwan

[21] Appl. No.: 196,567

[22] Filed: May 20, 1988

[51] Int. Cl.[4] ..... B65D 43/04

[52] U.S. Cl. ..... 220/282; 220/283

[58] Field of Search ..... 220/282, 283, 356, 357

[56] References Cited

U.S. PATENT DOCUMENTS 1,691,304 11/1928 Reid ..... 220/282

2,026,463 12/1935 Driess ..... 220/282

4,133,449 1/1979 Ostrowsky ..... 220/283

*Primary Examiner*—George T. Hall

*Attorney, Agent, or Firm*—Bacon & Thomas

[57] ABSTRACT

A rectangular container assembly having a cover and a base tray. The base tray has a flange member along the exterior surface of the wall of the base tray to keep the cover in position and has a sealing ring provided above the flange member to effect an intimate connection for this container. Each corner formed by the lateral wall of the cover is smoothly curtailed so as to facilitate the opening of this container by pressing one of the corners.

2 Claims, 5 Drawing Sheets

RECTANGULAR CONTAINER ASSEMBLY

BACKGROUND OF THE INVENTION

This invention relates to a rectangular container assembly, and more particularly relates to such a rectangular container assembly which is easily operated by a special designed cover.

Heretofore, various kinds of containers have been developed in many parts of the world in order to meet different requirements. It is obvious that most developements have been devoted to round-shaped containers; moreover, the improvement of the containers is showing a tendency to contain special contents so that the containers are required to be more precise and complicated.

This invention has arisen from work in seeking to be easily operated to contain general contents in rectangular containers.

SUMMARY OF THE INVENTION

A primary objective of the present invention is to provide a rectangular container assembly which can be easily opened by pressing one corner of the cover of such a rectangular container assembly.

Another objective of the present invention is to provide a rectangular container assembly which is easily manufactured.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
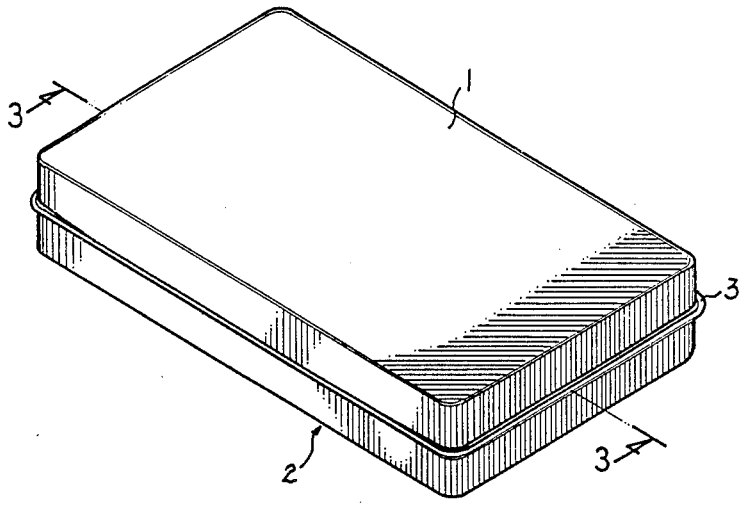
FIG. 1 is a perspective view of a rectangular container assembly in accordance with the present invention.
Figure 2:
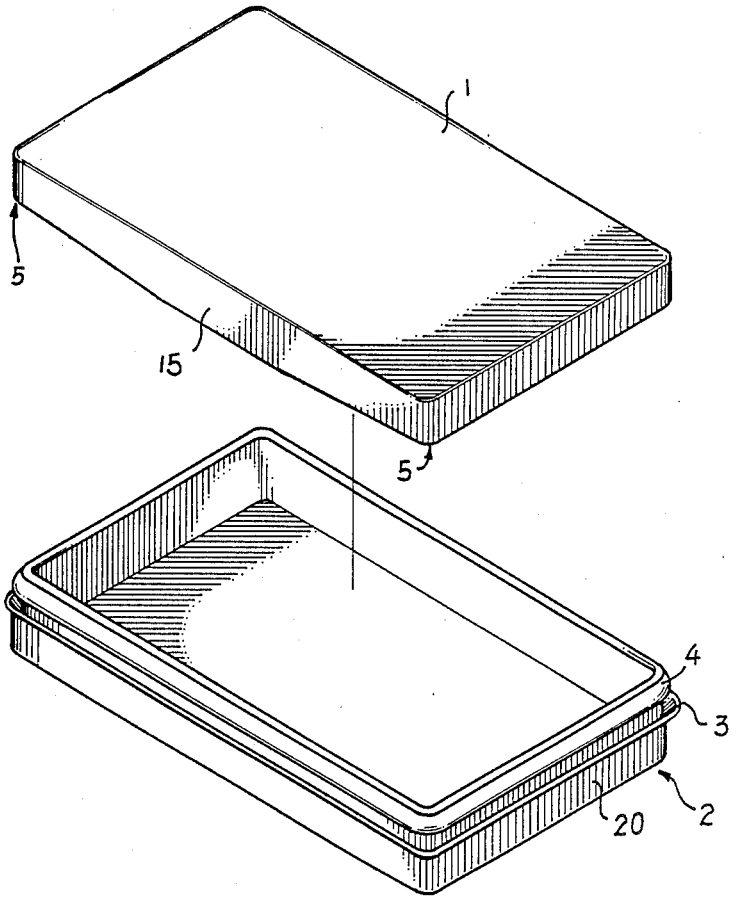
FIG. 2 is an exploded view of the rectangular container assembly of FIG. 1.

With reference to the drawings and particularly to FIGS. 1 and 2 thereof, it can be seen that a rectangular container assembly in accordance with the present invention comprises a cover 1 and a base tray 2.

As is common in conventional containers, the base tray 2 comprises a flange member 3 arranged along the exterior surface of the wall 20 thereof to keep the cover 1 in position. A sealing ring 4 is provided above, and approximate to, the flange member 3 to effect an intimate connection between the cover 1 and the base tray 2 when the cover 1 is combined with the base tray 2.

Figure 3:
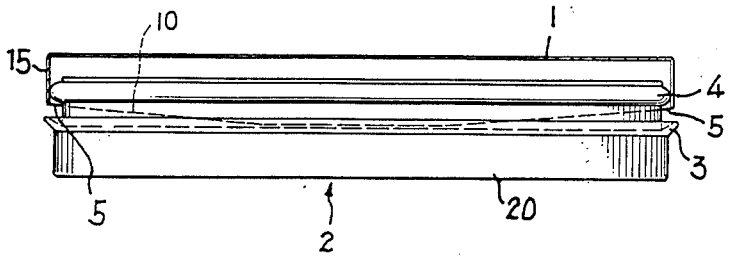
FIG. 3 is a cross-sectional view, taken along line 3—3, of the rectangular container assembly of FIG. 1.
Figure 4:
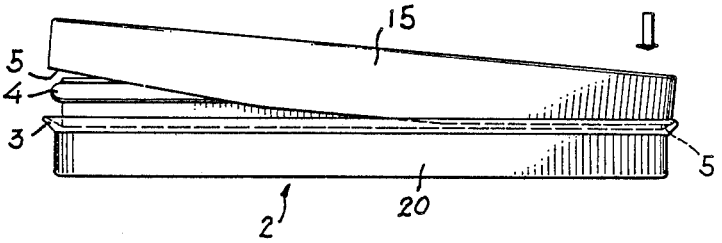
FIG. 4 is a working view of the rectangular container assembly of FIG. 1.

The outstanding feature of this invention is that each corner 5 formed by the lateral wall 15 of the cover 1 is curtailed so as to form a cutout between the cover 1 and the base tray 2, as shown in FIG. 3. The lateral wall 15 of the cover 1 is indicated in dotted lines 10 and the internal boundary of the flange member 3 bordering upon the base tray 2 is indicated in dotted lines 30. It should be noted that the cutout is smoothly formed along the lateral wall 15 of the cover 1 adjacent the corner 5 so that pressing one corner 5 of the cover 1 will raise adjacent corners 5 in order to facilitate the opening of this invention. As best shown in FIG. 4, only one corner 5 is drawn to be pressed, although it is apparent that each corner is pressable.

Figure 5:
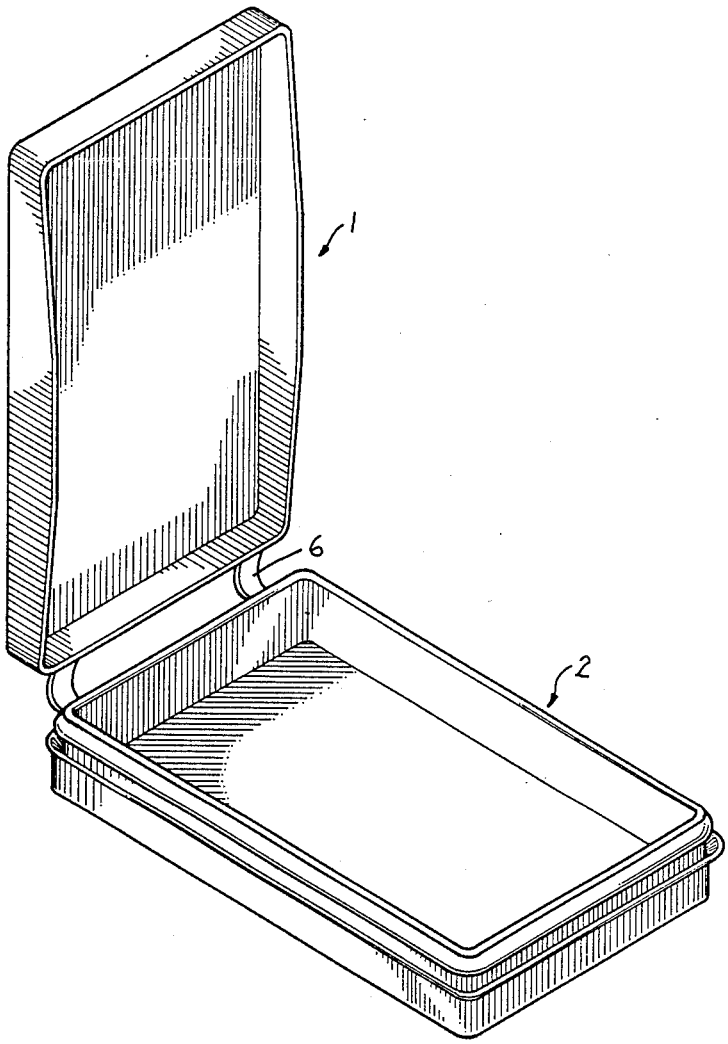
FIG. 5 is a perspective view of another embodiment in accordance with the present invention.
Figure 6:
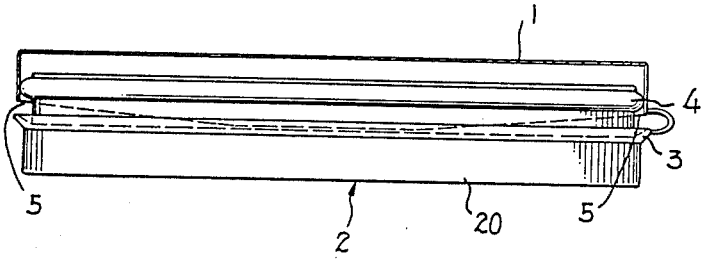
FIG. 6 is a cross-sectional view similar to FIG. 3, but illustrating the embodiment of FIG. 5.

Referring now to FIGS. 5–6, another embodiment as per this invention is disclosed wherein the cover 1 and the base tray 2 are laterally connected to each other by a pair of connectors 6. The operation of this embodiment is similar to the above-mentioned description and this embodiment can be employed to meet different requirements.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A rectangular container assembly comprising a cover (1) and a base tray (2), wherein said base tray (2) comprises a flange member (3) arranged along an exterior surface of a wall (20) thereof to keep said cover (1), and comprises a sealing ring (4) provided above said flange member (3) to effect an intimate connection between said cover (1) and said base tray (2);

each corner (5) formed by a lateral wall (15) of said cover (1) is smoothly curtailed so as to facilitate an opening of said rectangular container by pressing one of said corner (5).

2. A rectangular container assembly comprising a cover (1) and a base tray (2), wherein said base tray (2) comprises a flange member (3) arranged along an exterior surface of a wall (20) thereof to keep said cover (1), and comprises a sealing ring (4) provided above said flange member (3) to effect an intimate connection between said cover (1) and said base tray (2);

each corner (5) formed by a lateral wall (15) of said cover (1) is smoothly curtailed so as to facilitate an opening of said rectangular container by pressing one of said corner (5);

said cover (1) and said base tray (2) are laterally connected to each other by connectors (6).

* * * * *